US006527080B2

(12) United States Patent
Davies et al.

(10) Patent No.: US 6,527,080 B2
(45) Date of Patent: Mar. 4, 2003

(54) PASSIVE SYSTEM FOR SPEECH ENHANCEMENT

(75) Inventors: Dafydd Geraint Davies, Cambridge (GB); Keng D. Hsueh, West Bloomfield, MI (US); Peter J. Didyk, Dearborn Hgts., MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/728,805

(22) Filed: Dec. 2, 2000

(65) Prior Publication Data

US 2002/0066618 A1 Jun. 6, 2002

(51) Int. Cl.[7] ..... G10K 11/00
(52) U.S. Cl. ..... 181/175; 181/176; 181/141
(58) Field of Search ..... 181/175, 176, 181/150, 155, 141, 18, 30

(56) References Cited

U.S. PATENT DOCUMENTS

| | | | | |
|---|---|---|---|---|
| 2,643,727 A | | 6/1953 | Leon | |
| 3,908,095 A | * | 9/1975 | Jinsenji | 181/175 |
| 5,031,220 A | | 7/1991 | Takagi et al. | |
| 5,220,608 A | * | 6/1993 | Pfister | 181/155 |
| 5,268,539 A | | 12/1993 | Ono | |
| 5,532,438 A | * | 7/1996 | Brown | 181/155 |
| 5,850,060 A | | 12/1998 | Gerber et al. | |
| 5,979,590 A | | 11/1999 | Telmos | |

* cited by examiner

*Primary Examiner*—Khanh Dang
(74) *Attorney, Agent, or Firm*—Raymond L. Coppiellie

(57) ABSTRACT

A passive system for speech enhancement in a motor vehicle includes a headliner adapted to be disposed in an occupant compartment of the motor vehicle. The passive system also includes at least one passive sound reflector disposed in or near the headliner and being sound-reflective and shaped to direct or focus speech between front and rear seat occupants in the occupant compartment of the motor vehicle.

18 Claims, 2 Drawing Sheets

FIG 1
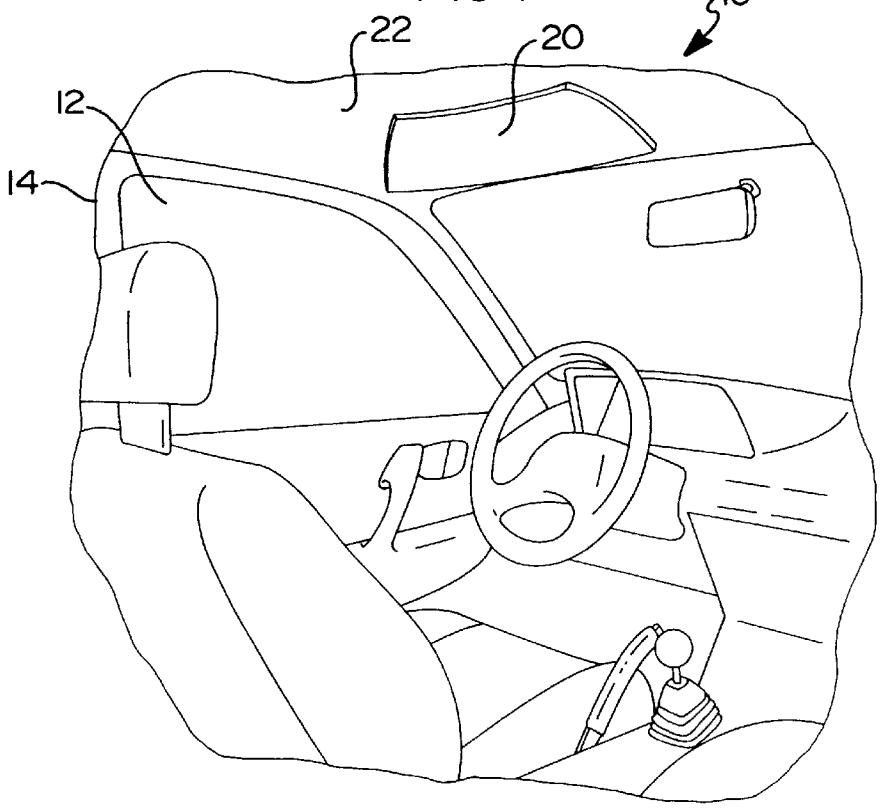
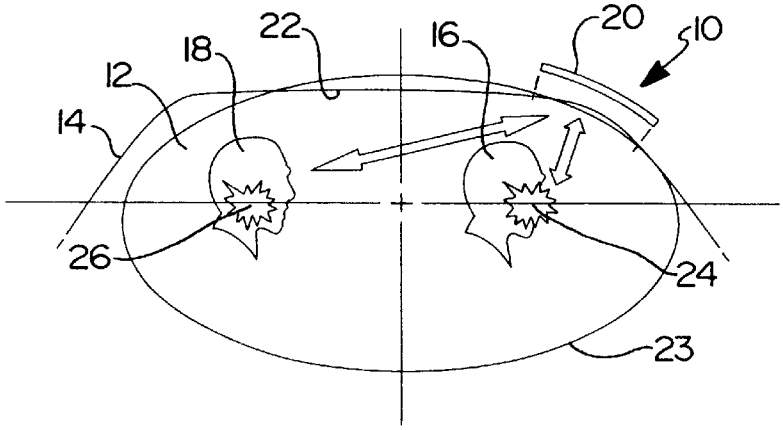
FIG 2

FIG 3
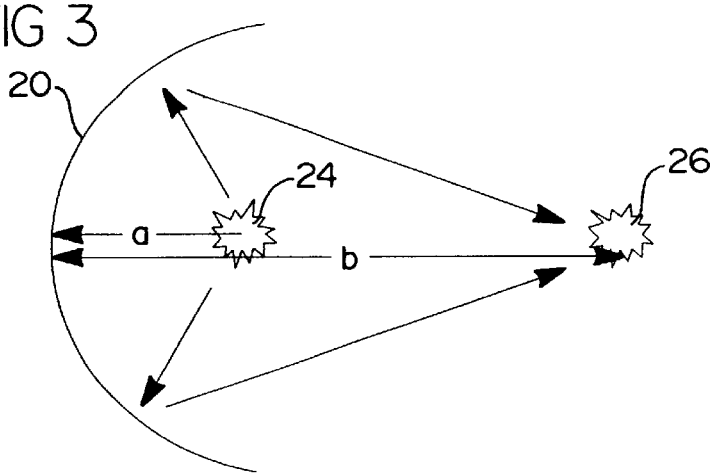
FIG 4
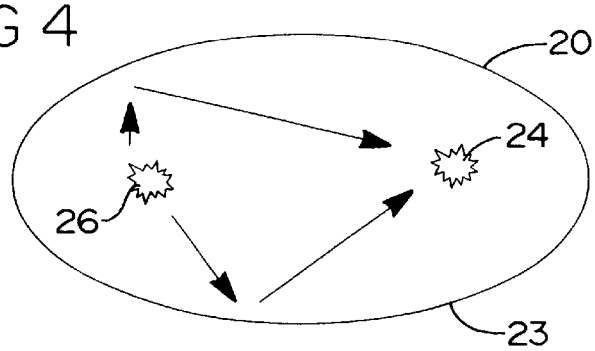
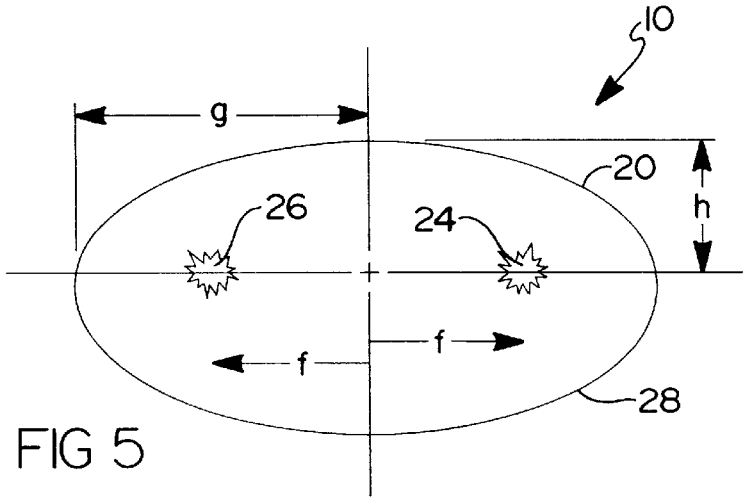
FIG 5

PASSIVE SYSTEM FOR SPEECH ENHANCEMENT

BACKGROUND OF THE INVENTION

1. Field of the Invention

The present invention relates generally to speech enhancement and, more specifically, to a passive system for speech enhancement in a motor vehicle.

2. Description of the Related Art

Speech is often not well audible between front and rear seat occupants in a motor vehicle because much of the interior furnishings are designed to absorb sound and because the occupants are not facing each other. Some motor vehicles use active speech relay systems for speech enhancement. For example, the active speech relay system is typically an electronic system, such as microphone-loudspeaker system, to relay conversation between front and rear seated occupants. However, these active speech relay systems require wiring, installation, switches, microphones, etc.

Although the above active speech relay systems have worked in vehicles, they are relatively expensive and therefore undesired. As such, it is desirable to improve speech intelligibility between front and rear seat occupants in a motor vehicle. It is also desirable to provide relatively low cost speech enhancement in a motor vehicle. Therefore, there is a need in the art to provide a passive system for speech enhancement in a motor vehicle.

SUMMARY OF THE INVENTION

Accordingly, the present invention is a passive system for speech enhancement in a motor vehicle including a headliner adapted to be disposed in an occupant compartment of the motor vehicle. The passive system also includes at least one passive sound reflector disposed in or near the headliner and being sound-reflective and shaped to direct or focus speech between front and rear seat occupants in the occupant compartment of the motor vehicle.

One advantage of the present invention is that a passive system for speech enhancement is provided for a motor vehicle. Another advantage of the present invention is that the passive system improves speech intelligibility between front and rear seat occupants. Yet another advantage of the present invention is that the passive system uses passive sound-focusing elements to improve front-back speech audibility in a motor vehicle. Still another advantage of the present invention is that the passive system is relatively low cost for a motor vehicle.

Other features and advantages of the present invention will be readily appreciated, as the same becomes better understood, after reading the subsequent description taken in conjunction with the accompanying drawings.

BRIEF DESCRIPTION OF THE DRAWINGS

FIG. 1 is a perspective view of a passive system for speech enhancement, according to the present invention, illustrated in operational relationship with a motor vehicle.

FIG. 2 is a side exploded view of the passive system for speech enhancement of FIG. 1 illustrating speech between a front and rear occupant of the motor vehicle.

FIG. 3 is a diagrammatic side view of the passive system for speech enhancement of FIG. 1.

FIG. 4 is a diagrammatic front view of the passive system for speech enhancement of FIG. 1.

FIG. 5 is a diagrammatic front view of the passive system for speech enhancement of FIG. 1.

DESCRIPTION OF THE PREFERRED EMBODIMENT (S)

Referring to the drawings and in particular FIGS. 1 and 2, one embodiment of a passive system 10, according to the present invention, is illustrated for speech enhancement in an occupant compartment 12 of a motor vehicle 14. The passive system 10 is to be used by a front seat occupant 16 and a rear seat occupant to enhance speech between them in the occupant compartment 12 of the motor vehicle 14. It should be appreciated that, except for the passive system 10, the motor vehicle 14 is conventional and known in the art.

Referring to FIGS. 1 through 3, the passive system 10 includes a sound reflector 20 mounted to or integrated as part of a headliner 22 in the occupant compartment 12 of the motor vehicle 14. The sound reflector 20 is a section of an ellipsoid 23 having a generally dish shape that will take sound from the position of the front seat occupant 16 to the rear seat occupant 18. As illustrated in FIG. 3, the sound reflector 20 has a generally arcuate cross-sectional shape with a first focus 24 at a first distance "a" and a second focus 26 at a second distance "b" therefrom. As illustrated in FIG. 2, the front seat occupant 16 generally corresponds to the first focus 24 and the rear seat occupant 18 generally corresponds to the second focus 26. It should be appreciated that the second distance "b" is greater than the first distance "a". It should also be appreciated that the sound reflector 20 has a cross-sectional shape that looks similar to a parabola, but is not a parabola, because a parabola cannot focus sound back at a point which is a distance away, that is, less than infinity.

Referring to FIG. 4, to get the sound back to the second focus 26, the sound reflector 20 is a section of the ellipsoid 23. The sound reflector 20 has a rear seat or second focus 26 of approximately one foot across. The sound reflector 20 creates a slightly defocused image, and is not a perfect ellipse to avoid a point focus and provide a sound zone that is quite wide to allow the occupants 16 and 18 to be able to hear the sound if either one moves around. The sound reflector 20 may be located along the headliner 22 near a sun-visor (not shown). The sound reflector 20 may be connected to the headliner 22 by suitable means (not shown). The sound reflector 20 may be integral, unitary, and one-piece with the headliner 22. The sound reflector 20 may be integrated into the curve of the headliner 22 near a front thereof. It should be appreciated that the sound reflector 20 may be the sun-visor for the motor vehicle 14. It should also be appreciated that the sound reflector 20 is disposed in or near to the headliner 22 and is sound-reflective and shaped to direct or focus the sound between the front seat occupant 16 and rear seat occupant 18. It should further be appreciated that exact focal positions are not required because there will be a zone of different positions where the occupant's ears and mouth might be, rather than single points, hence, the shapes will not be exact three-dimensional conic sections. It should still further be appreciated that the shapes are also optimized to give the best compromise between front-mouth-to-back-ear and back-mouth-to-front-ear focusing, which may be slightly incompatible because they are over different ray paths.

Referring to FIG. 5, the sound reflector 20 is first designed as a perfect ellipse 28. The equation for the ellipse 28 with focal points +/−f is:

$$x^2/c^2+y^2/d^2=1(c>d)$$

where f=square root of $(c^2-d^2)$=focal length and b corresponds to c and a corresponds to d. To obtain the desired ellipse shape, c and d are adjusted until the ellipse 28 is obtained with the desired 2f (=head-at-front to head-at-back distance=b−a), which also passes approximately through the position of the headliner 22. Next, the ellipsoid 23 is formed as a surface of revolution of the ellipse 28 defined above and a section of the ellipsoid 23 is isolated to form the sound reflector 20 in the motor vehicle 14 as illustrated in FIG. 2. It should be appreciated that the sound reflector 20 has a three-dimensional shape. It should also be appreciated that an ellipsoid equation with three different (non-equal) axes could be used to form a three-dimensional shape, provided that foci are still in the correct positions, and that the shape of the surface of revolution could be elongated somewhat along the direction of the headliner 22 (i.e. parallel to the major axis of the windshield) without significant performance degradation, should this be required by aesthetics or mechanical interference considerations. It should further be appreciated that a three-dimensional shape could be obtained by rotating a section of the ellipse 28 around the x-axis but would make the sound reflector 20 too scoopy and needs to be flatter along the headliner 22. It should further be appreciated that the important part about the shape of the sound reflector 20 is the focal length (f).

The sound reflector 20 is made of a sound reflecting material, which materials are conventional and known in the art. The sound reflector 20 has a size similar to that of a sun-visor. The sound reflector 20 may include sub-elements (not shown) designed to focus and point in different directions, for example, left and right rear seat passengers to allow both to have improved conversation with the driver occupant. The sound reflector 20 is effective only for a range of predetermined frequencies, that is, about 1 kHz and higher, because lower frequencies will have wavelengths larger than the sound reflector 20. It should be appreciated that the range of predetermined frequencies is acceptable since higher frequencies are most critical to speech intelligibility. It should also be appreciated that it is the driver front seat occupant 16 who cannot turn around to talk to the rear seat occupant 18 so the sound reflector 20 is only needed on the driver's side of the motor vehicle 14.

In operation of the sound reflector 20, the front seat occupant 16 speaks with his or her mouth that corresponds to the first focus 24. The sound corresponding thereto has a frequency that travels to and is reflected by the sound reflector 20. The reflected sound travels to the second focus 26, which corresponds with the ears of the rear seat occupant 18. The operation is reversed for the rear seat occupant 18 speaking to the front seat occupant 16. It should be appreciated that the ray paths for the front-back and back-front mouth-ear are very similar and the sound reflector 20 works for both paths, especially since there is a "fuzzy" focus to allow for the head being in slightly different positions. It should also be appreciated that the sound reflector 20 will double the speech intensity to approximately 6 dB between the front seat occupant 16 and rear seat occupant 18.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A passive system for speech enhancement in a motor vehicle comprising:

a headliner adapted to be disposed in an occupant compartment of the motor vehicle; and at least one passive sound reflector disposed in said headliner and being sound-reflective and shaped to direct or focus speech between front and rear seat occupants in the occupant compartment of the motor vehicle.

2. A passive system as set forth in claim 1 wherein said sound reflector is a section of an ellipsoid.

3. A passive system as set forth in claim 1 wherein said sound reflector is made of a sound reflecting material.

4. A passive system as set forth in claim 1 wherein said sound reflector is connected to said headliner.

5. A passive system as set forth in claim 4 wherein said sound reflector and said headliner are integral, unitary, and one-piece.

6. A passive system as set forth in claim 1 wherein said sound reflector has a first focus and a second focus spaced longitudinally from said first focus.

7. A passive system as set forth in claim 6 wherein said first focus corresponds to a front seat occupant and said second focus corresponds to a rear seat occupant.

8. A passive system as set forth in claim 1 wherein said sound reflector has a curvature according to the equation $x^2/c^2+y^2/d^2=1$, where b corresponds to c and a corresponds to d and a=distance of a first focus and b=distance of a second focus.

9. A passive system as set forth in claim 8 wherein said sound reflector has a focal length equal to a square root of $(c^2-d^2)$,where b corresponds to c and a corresponds to d and a=distance of a first focus and b=distance of a second focus.

10. A passive system as set forth in claim 1 wherein said sound reflector reflects sound for a range of predetermined frequencies.

11. A passive system as set forth in claim 10 wherein said predetermined frequencies are about 1 kHz and higher.

12. A passive system as set forth in claim 1 wherein said sound reflector has a size similar to that of a sun-visor.

13. A passive system as set forth in claim 1 wherein said sound reflector has a three-dimensional shape.

14. A passive system as set forth in claim 1 wherein said sound reflector has a curvature of an ellipse with a desired 2f (=head-at-front to head-at-back distance=b−a), where f=focal length and a=distance of a first focus and b=distance of a second focus.

15. A passive system for speech enhancement in a motor vehicle comprising:

a headliner adapted to be disposed in an occupant compartment of the motor vehicle; and at least one passive sound reflector disposed in said headliner and being sound-reflective and a section of an ellipsoid to reflect sound for a range of predetermined frequencies of at least one kilohertz to focus speech between front and rear seat occupants in the occupant compartment of the motor vehicle.

16. A passive system as set forth in claim 15 wherein said sound reflector is made of a sound reflecting material.

17. A passive system as set forth in claim 15 wherein said sound reflector and said headliner are integral, unitary, and one-piece.

18. A motor vehicle comprising:

an occupant compartment;

a headliner disposed in said occupant compartment; and a passive sound reflector disposed in said headliner and being sound-reflective and shaped as a section of an ellipsoid to direct or focus speech between front and rear seat occupants in said occupant compartment.

* * * * *